US005950601A

United States Patent [19]

Nemoto et al.

[11] Patent Number: 5,950,601

[45] Date of Patent: Sep. 14, 1999

[54] FUEL INJECTION SYSTEM FOR ENGINES

[75] Inventors: Hideki Nemoto; Tadashi Uchiyama; Tomoaki Kakihara, all of Fujisawa, Japan

[73] Assignee: Isuzu Motors Limited, Tokyo, Japan

[21] Appl. No.: 08/993,991

[22] Filed: Dec. 18, 1997

[30] Foreign Application Priority Data

Dec. 26, 1996 [JP] Japan ..... 8-356476

[51] Int. Cl.[6] ..... F02M 33/04

[52] U.S. Cl. ..... 123/495; 123/446; 92/129

[58] Field of Search ..... 123/446, 495; 92/129

[56] References Cited

U.S. PATENT DOCUMENTS

| | | | |
|---|---|---|---|
| 3,880,054 | 4/1975 | Domyan | 92/129 |
| 5,325,834 | 7/1994 | Ballheimer et al. | 123/446 |
| 5,515,829 | 5/1996 | Wear et al. | 123/446 |
| 5,722,373 | 3/1998 | Paul et al. | 123/446 |

FOREIGN PATENT DOCUMENTS

| | | |
|---|---|---|
| 0149598 | 7/1985 | European Pat. Off. . |
| 0631045 | 12/1994 | European Pat. Off. . |
| 2717902 | 10/1978 | Germany . |
| 6-294362 | 10/1994 | Japan . |
| 6-511524 | 12/1994 | Japan . |

*Primary Examiner*—Thomas N. Moulis
*Attorney, Agent, or Firm*—Browdy and Neimark

[57] ABSTRACT

In this fuel injection system, a larger-diameter portion and a smaller-diameter portion which constitute each intensifying piston are brought into contact with a convex surface, whereby the bending of the smaller-diameter portion can be prevented when an external force exerted on the larger-diameter portion causes it to incline. The smaller-diameter portion and larger-diameter portion are formed separately, urged by a return spring and engaged with each other. Even when an injector body is inclined due to an external force and thermal stress to cause the larger-diameter portion to nearly follow up the inclining of the injector body, a contact point of the flat bottom surface of the larger-diameter portion and the convex top surface formed on the smaller-diameter portion is merely shifted due to the rolling of these surfaces. Since the smaller-diameter portion does not receive a bending effect by the larger-diameter portion, inconvenience, such as a galling between the smaller-diameter portion and a bore-defining surface of a fuel supply body does not occur.

8 Claims, 7 Drawing Sheets

FUEL INJECTION SYSTEM FOR ENGINES

BACKGROUND OF THE INVENTION

1. Field of the Invention

This invention relates to a fuel injection system for engines, adapted to increase the pressure of a fuel in pressure intensifying chambers, which is supplied from a common rail, by pressure intensifying pistons.

2. Description of the Prior Art

The conventional hydraulically operated electronically controlled fuel injection systems for engines include, for example, the fuel injection systems disclosed in Japanese Patent Laid-Open Nos. 294362/1994 and 511524/1994. In these fuel injection systems, it is rendered possible to variably control the flow rate characteristics of a fuel in the hydraulically operated injectors in a fuel injection stroke of the engines, and start the engines speedily, these fuel injection systems having a construction shown in, for example, FIG. 5.

As shown in FIG. 5, a fuel injection system 1 has a body provided with a bore and an injection port 13, and a case 6 disposed on the outer side of the body so as to form a clearance constituting a fuel chamber 20. The body of the fuel injection system comprises a nozzle body 2 provided with a bore 46 and the injection port 13 for injecting a fuel into a combustion chamber 130 (FIG. 6), a fuel supply body 5 forming a pressure intensifying chamber 7, a spacer body 81 and a hollow spacer body 21 having a bore 29, an injector body 4 provided with a pressure chamber 8 to which a high-pressure operating oil is supplied, and a solenoid body 3 provided with a drain groove 39 and a drain passage 38, which constitute leak passages, and a solenoid valve 16. The case 6 surrounds the nozzle body 2, spacer body 81, hollow spacer body 21 and fuel supply body 5 so as to form the fuel chamber 20. The case 6 is engaged with and sealed by a contact surface 14 of a stepped portion of the nozzle body 2 at one end portion thereof, and sealed with a fitting surface 80, which is screwed on the injector body 4, at the other end portion thereof, so as to form the fuel chamber 20 between the case 6 and body. A fuel supply port 11 and a fuel discharge port 12 formed in the case 6 are opened in a common rail 51, from which a fuel is supplied at all times to the fuel chamber 20.

In order to supply the fuel to the pressure intensifying chamber 7 formed in the fuel supply body 5 for the purpose of increasing the pressure of fuel fed from the fuel chamber 20 thereto, and then from the pressure intensifying chamber 7 to the injection port 13, the fuel injection system 1 has the spacer body 81, a fuel passage 22 formed in the hollow spacer body 21 and nozzle body 2, a needle valve 23 retained slidably in the bore 46 of the nozzle body 2 and adapted to open the injection port 13 by a fuel pressure, an intensifying piston 9A for increasing the pressure of the fuel in the intensifying chamber, the pressure chamber 8 into which a high-pressure operating oil by which a high pressure is applied to an end portion of the intensifying piston 9A is supplied, and the solenoid valve 16 for controlling the supplying of the high-pressure operating oil to the pressure chamber 8.

A return spring 18 is provided in a bore 29 formed in the hollow spacer body 21, and urges by its resilient force the needle valve 23 in the closing direction of the injection port 13. One end of the return spring 18 is engaged with an upper end of the needle valve 23, and the other end thereof the spacer body 81. A spring chamber 30, which is formed of the bore 26, in the hollow portion of the injector body 4, is formed between an end surface of a larger-diameter portion 25A of the intensifying piston 9A and that of the fuel supply body 5. The spring chamber 30 is provided therein with a return spring 17 urging the intensifying piston 9A toward the pressure chamber 8. A bore 85 formed in the injector body 4 is provided therein with a return spring 19 urging the solenoid valve 16 toward the operating oil cutting off side. The spring chamber 30 in which the intensifying piston 9A is provided communicates with the fuel chamber 20 via a discharge passage 83 formed in the fuel supply body 5 and a check valve 84 provided in the discharge passage 83. A leakage fuel usually flows into the spring chamber 30, and the fuel pressure in the spring chamber 30 is equal to that in the fuel chamber 20, the leakage fuel which has entered the spring chamber 30 being discharged therefrom due to the reciprocating movement of the intensifying piston 9A to form a hollow space therein.

The intensifying piston 9A comprises a smaller-diameter portion 24A defining at its lower end surface a part of the intensifying chamber 7 and constituting a plunger, a larger-diameter portion 25A defining at its upper end surface a part of the pressure chamber 8 and reciprocatingly moved in the bore 26 of the injecter body 4, and a guide ring portion 41A suspended from the whole circumference of an outer circumferential section 47 of the larger-diameter portion 25A and forming a slide surface 49 slidingly moving on an inner surface of the bore 26. The guide ring portion 41A has the function of stabilizing a vertical movement of the intensifying piston 9A. The smaller-diameter portion 24A of the intensifying piston 9A reciprocatingly moves in a bore 42 formed in the fuel supply body 5, and the larger-diameter portion 25A thereof in the bore 26 formed in the injector body 4. The bore 26 of the injector body 4 is provided therein with a seal member 44, with which a clearance between the intensifying piston 9A and a wall of the injector body defining the bore 26 is sealed, whereby the spring chamber 30 and pressure chamber 8 are shut off from each other so that the high-pressure operating oil in the pressure chamber 8 does not leak into the spring chamber 30. In order to return the intensifying piston 9A, the return spring 17 is provided in a compressed state between the fuel supply body 5 and intensifying piston 9A. Although the smaller-diameter portion 24A and larger-diameter portion 25A are shown as an integral structure in FIG. 5, they can be formed separately as shown in FIG. 7 and as will be described later.

The intensifying chamber 7 is formed in an end portion of the bore 42 formed in the fuel supply body 5. The supplying of a fuel to the intensifying chamber 7 is done from the fuel chamber 20 and through a fuel passage 37 formed in the hollow spacer body 21 and a fuel passage 35 formed in the spacer body 81. The fuel passage 35 is provided with a check valve 36 so as to prevent the high-pressure fuel in the intensifying chamber 7 from flowing back to the fuel chamber 20. The pressure-increased fuel in the intensifying chamber 7 is supplied to the injection port 13 via the fuel passage 22 formed in the hollow spacer body 21 and nozzle body 2. Between the nozzle body 2 and needle valve 23, a fuel passage is formed, and the needle valve 23 is lifted when the high-pressure fuel is applied to a tapering surface 45 of a lower end portion of the needle valve 23. The needle valve 23 is returned slidably in the bore 46 of the nozzle body 2 and lifted by the fuel pressure to open the injection port 13.

The intensifying piston 9A has a flat surface 73 formed by cutting off an outer circumferential portion of a top surface 65, which faces the pressure chamber 8, of the larger-diameter portion 25A. A wall surface, which defines the pressure chamber 8, of the injector body 4 constitutes a flat wall surface 72 parallel to the top surface 65 of the intensifying piston 9A. Accordingly, a narrow annular clearance 74 is formed between the flat surface 73 of the intensifying piston 9A and the flat wall surface 72 of the injector body 4 in the pressure chamber 8. A projecting portion on a central section of the top surface 65 of the intensifying piston 9A is engaged with the flat wall surface 72 of the injector body 4 by a resilient force of the return spring 17.

The spring chamber 30 in which the return spring 17 is held is formed as the bore 26 formed in the injector body 4, in which the larger-diameter portion 25A of the intensifying piston 9A and the guide ring 41A are slidingly moved. Since the clearance between the intensifying piston 9A and the bore 26 of the injector body 4 is sealed with the seal member 44 provided between the larger-diameter portion 25A and bore 26, the leakage of the fuel from the spring chamber 30 into the pressure chamber 8 is prevented.

The fuel entering the spring chamber 30 is discharged to the fuel chamber 20 through the discharge passage 83 formed in the fuel supply body 5. The fuel from the fuel chamber 20 leaks into the spring chamber 30, in which the return spring 17 for the intensifying piston 9A is provided, through a very narrow clearance 28 between the slide surfaces, i.e. the outer circumferential surface of the plunger constituting the smaller-diameter portion 24*a,* i.e., the bore 42 of the fuel supply body 5 and that of the smaller-diameter portion 24A and a very narrow clearance 48 between the contact surfaces of the injector body 4 and fuel supply body 5. The fuel entering the spring chamber 30 is discharged to the fuel chamber 20 through the discharge passage 83. Since the check valve 84 is provided in the discharge passage 83, a backward flow of the fuel from the fuel chamber 20 into the spring chamber 30 through the discharge passage 83 is prevented. A hollow space corresponding to a stroke of the intensifying piston 9A is normally formed in the spring chamber 30, and holds the fuel therein. When the fuel enters the hollow space in the spring chamber 30 to around a level which is not higher than a level corresponding to a stroke of the intensifying piston 9A, the fuel in the spring chamber 30 in the bore 26 can be discharged to the fuel chamber 20 through the discharge passage 83 in accordance with the reciprocating movement of the intensifying piston 9A but a backward flow of this fuel is prevented by the operation of the check valve 84.

As shown in FIG. 4, a fuel supply system for an engine is provided with a fuel injection system 1 in each cylinder. The fuel injection systems 1 are provided with a common rail 51, a common passage for the supplying of a fuel. The fuel in a fuel tank 52 is supplied to the common rail 51 through a filter 54 by an operation of a fuel pump 53. The common rail 51 communicates with each fuel injection system 1, and the fuel is recovered to the fuel tank 52 through a fuel recovery passage 55. Each injection system 1 is provided in the common rail 51 from which a fuel of a predetermined pressure is supplied constantly to the fuel supply port 11 and fuel discharge port 12.

The fuel injection systems 1 are formed so that a high-pressure operating fluid, i.e. an operating oil is supplied to the pressure chambers 8 for the purpose of increasing the fuel pressure. The fuel injection systems 1 are connected to a high-pressure manifold 56. An oil from an oil reservoir 57 is supplied to the high-pressure manifold 56 through an oil supply passage 61 by an operation of an oil pump 58, and an oil cooler 59 and an oil filter 60 are provided in an intermediate portion of the oil supply passage 61. The oil supply passage 61 branches into a lubricant passage 67 communicating with an oil gallery 62, and an operating oil passage 66 from which an oil is supplied to the pressure chambers 8 of the fuel injection systems 1. The operating oil passage 66 is provided with a high-pressure oil pump 63, and the supplying of an oil from the high-pressure oil pump 63 to the high-pressure oil manifold 56 is controlled via a flow rate control valve 64.

The controller 50 is adapted to control the flow rate control valve 64 and solenoids 10 of the fuel injection systems 1. A rotational frequency of the engine detected by a rotation sensor 68, a degree of opening of an accelerator detected by a load sensor 69 and a crank angle detected by a position sensor 70 are inputted as information on the operating condition of the engine into the controller 50. The operating oil pressure in the high-pressure oil manifold 56 which is detected by a pressure sensor 71 provided in the high-pressure manifold 56 is also inputted into the controller 50.

As shown in FIG. 5, in each fuel injection system 1, the operation of the needle valve 23 for opening and closing of the injection port 13 is carried out by a control operation of the solenoid 10. When the solenoid 10 is energized by an instruction from the controller 50, an armature 32 is attracted thereto, and the solenoid valve 16 fixed to the armature 32 is lifted against the resilient force of the return spring 19. When the solenoid valve 16 is lifted, a passage 33 formed between the tapering surface 86 of the solenoid valve 16 and a valve seat 87 of the injector body 4 is opened, and a high-pressure operating oil is supplied from the high-pressure oil manifold 56 to the pressure chamber 8 through the supply passage 31 and passage 34 which are formed in the injector body 4. When the high-pressure operating oil is supplied to the pressure chamber 8, it is then supplied to the annular clearance 74 formed between the for surface 65 of the larger-diameter portion 25A of the intensifying piston 9A and the wall surface 72 of the injector body 4, whereby an operating pressure is applied to the intensifying piston 9A. The fuel in the common rail 51 is supplied from the supply port 11 formed in the case 6 to the fuel chamber 20, and then from the fuel chamber 20 to the intensifying chamber 7 through the fuel passage 37 formed in the hollow spacer body 21 and fuel passage 35 formed in the spacer body 81.

When the intensifying piston 9A is moved down due to the pressure of the operating oil in the pressure chamber 8, the fuel passage 35 is closed with the check valve 36, the fuel pressure in the intensifying chamber 7 is increased. When the pressure of the fuel in the intensifying chamber 7 is increased, the fuel pressure causes the needle valve 23 to be lifted against the resilient force of the return spring 18. When the solenoid valve 16 is released from the energizing power of the solenoid 10, the solenoid valve 16 is moved down due to the resilient force of the return spring 19, and the drain grooves 39 provided in the solenoid body 3 are opened, so that the high-pressure operating oil in the pressure chamber 8 is discharged through the drain grooves 39 and drain passage 38. When the high-pressure operating oil is discharged, the intensifying piston 9A returns to the original position by the resilient force of the return spring 17, and the pressure in the intensifying chamber 7 becomes equal to that in the fuel chamber 20, the fuel pressure applied to the needle valve 23 decreasing, the tapering surface 45 of the needle valve 23 sitting on the valve seat of the nozzle body 2 due to the resilient force of the return spring 18 to close the injection port 13.

The injector body 4 is fixed to the cylinder head. FIG. 6 shows a fuel injection system 1 fixed to a cylinder head 75. In the fuel injection system 1 fixed to the cylinder head 75, a packing 96 inserted between a shoulder portion 79 (corresponding to the case 6 of FIG. 5) of the injector and a mounting hole 95 of the cylinder head 75 is compressed. Accordingly, the sealing of the combustion chamber 130 and mounting hole 95 and the sealing of the common rail 51 formed in the cylinder head 75 are effected by this packing 96. If the direction of a tightening force is not aligned with the axis of the injector body 4 when the injector body 4 is fixed to the cylinder head 75 by using a clamp member and a tightening bolt, the moment of inclining the injector body 4 occurs.

The applicant of the present invention has proposed an engine produced as an engine provided with electronically controlled hydraulically driven fuel injection systems, by making a cylinder head 75 of an aluminum alloy, and a manifold 56 a material of a high rigidity, such as FC cast iron. A flange 77 is placed on the cylinder head 75 so that a lower surface 43 of the flange 77 engages a fixing surface 82 of the cylinder head 75, and the manifold 56 is fixed to the cylinder head via the flange 77. In order to supply an operating fluid from the manifold 56 to the injector body 4, the injector body 4 and manifold 56 are connected together by a supply pipe 78.

The cylinder head 75 made from aluminum is expanded by heat in accordance with the operation of the engine. Since the height of a fixing surface 94 of the case 6 for the injector body 4 with respect to the cylinder head 75 and that of the fixing surface 82 of the cylinder head 75 on which the flange 77 for supporting the manifold 56 are different, a distance between the fixing surface 94 of the case 6 for the injector and that 82 of the cylinder head 75 increases in accordance with the thermal expansion of the cylinder head 75 as compared with the original distance therebetween. Concretely speaking with the lower surface 76 of the cylinder head determined as a reference surface, thermal expansion occurs in the cylinder head 75 during a high load operation in which the temperature of the engine becomes high, and the lower surface 43 of the manifold 56 extends longer than the fixing surface 94 of the injector, and becomes higher than when the temperature is normal. Since the injector body 4 is fixed to the cylinder head 75 by a clamp member and tightening bolt as mentioned above, the moment M of inclining the injector body 4 toward the side thereof which is opposite to the side on which the manifold 56 is provided occurs in the injector body 4 as shown by an arrow.

Since the thermal expansion coefficient of the cylinder head 75 made from aluminum and that of the manifold 56 made from FC cast iron are different, a difference occurs between the thermal expansion quantities thereof. When a difference in the thermal expansion quantities occurs in the direction of the square plane to the fixing surface 82, a bend generating force corresponding to this difference is applied to the injector body 4 by the manifold 56.

The injector body 4 is inclined with respect to the fuel supply body 5 in some cases due to the tightening force of the clamp member and due to the displacement and deformation thereof based on the thermal expansion thereof. FIG. 7 is a sectional view of a principal portion of an injector body 4 which is around the intensifying piston 9, in the condition in which such inclination occurs in the injector body 4. As shown in FIG. 7, the intensifying piston 9 comprises separately formed smaller-diameter portion 24 and larger-diameter portion 25. A movement of a spring retainer 105 fitted around the smaller-diameter portion 24 is restricted by a snap ring 104 fitted in a circumferential groove 103 formed in the section of the smaller-diameter portion 24 which is away from a top surface 101 thereof by a predetermined distance. The return spring 17 is provided in a compressed state between the upper surface of the fuel supply body 5 and spring retainer 105, and the flat top surface 101 of the smaller-diameter portion 24 is engaged with a flat bottom surface 102 of the larger-diameter portion 25 via the spring retainer 105 and snap ring 104 in the mentioned order.

In FIG. 7, the displacement and deformation of each part are shown in an exaggerated manner. Especially, the inclination of the injector body 4 is shown exaggeratedly but the inclination is very little in practice, i.e., a very narrow clearance 48 between the contact surfaces of the injector body 4 and fuel supply body 5 is not expanded. When the injector body 4 is inclined, the larger-diameter portion 25 of the intensifying piston 9 is also going to follow up the inclining thereof as shown by an arrow in the drawing. If the top surface 101 of the smaller-diameter portion 24 and the bottom surface 102 of the larger-diameter portion 25 are flat, the larger-diameter portion 25 exerts a lowering force, when it is inclined even slightly, facing to the outer circumferential edge of the smaller-diameter portion 24. Consequently, the bending moment occurring in the smaller-diameter portion 24 and causes the smaller-diameter portion 24 to incline. A lower section of the smaller-diameter portion 24 is fitted in the bore 42 of the fuel supply body 5 and thereby restrained. Accordingly, the bending moment occurs in the direction in which the larger-diameter portion 25 inclines, and the smaller-diameter portion 24 receives a bending force as shown in the drawing.

The bending moment and a bending force exerted on the smaller-diameter portion cause galling and sticking to occur in the regions, in which edges shown by reference letters A and B in FIG. 7 exist, between the smaller-diameter portion 24 and a wall defining the bore 42. As a result, a large resistance to the reciprocating movement of the smaller-diameter portion 24 occurs. This causes an imperfect operation of the intensifying piston 9 and an abnormal abrasion of the slide surfaces of the smaller-diameter portion 24 and the wall defining the bore 42 to occur. Consequently, a leakage amount of the fuel in the intensifying chamber 7 increases, and desired levels of injection pressure and injection rate cannot be obtained.

SUMMARY OF THE INVENTION

An object of the present invention is to solve these problems, and provide a fuel injection system for engines, capable of preventing, even when the larger-diameter portion of the intensifying piston inclines in accordance with the inclining of the injector body, the smaller diameter-portion thereof from following up with the inclining of the larger-diameter portion; operating the intensifying piston smoothly by reciprocatingly moving the smaller-diameter portion without receiving a resistance; preventing the leakage of the fuel in the intensifying chamber, which is ascribed to the occurrence of abnormal abrasion of the slide surfaces of the smaller-diameter portion and a wall defining the bore of the fuel supply body; and thereby obtaining desired levels of injection pressure and injection rate.

The present invention relates to a fuel injection system for engines, comprising intensifying chambers, to which a fuel from a common rail is supplied, formed in injector bodies, intensifying pistons adapted to be driven by an operating fluid supplied to pressure chambers formed in the injector bodies so as to increase the pressure of fuel in the intensifying chambers, needle valves adapted to be lifted in the injector bodies so as to open and close by a fuel pressure the injection ports from which the fuel from the intensifying chamber is injected, control valves for controlling the supplying of the operating fluid to the pressure chambers for the purpose of driving the intensifying piston properly, return springs for returning the intensifying pistons, and cases provided on the outer circumferential sides of the injector bodies so as to form fuel chambers, and having fuel supply ports and fuel discharge ports which are opened in the common rail, the intensifying pistons comprising larger-diameter portions forming parts of wall surfaces of the pressure chambers, and smaller-diameter portions forming parts of the wall surfaces of the intensifying chambers and engaged with the larger-diameter portions by the resilient force of the return springs, at least one of the top surfaces of the smaller-diameter portions and the bottom surfaces, with which the formers are engaged, of the larger-diameter portions being formed as convex surfaces.

In this fuel injection system for engines, each intensifying piston comprises as mentioned above a larger-diameter portion forming a part of a wall surface of a pressure chamber, and a smaller-diameter portion forming a part of a wall surface of the intensifying chamber and engaged with the larger-diameter portion by the resilient force of a return spring, and at least one of a top surface of the smaller-diameter portion and a bottom surface of the larger-diameter portion with which this top surface is engaged is formed as a convex surface. Therefore, even when the larger-diameter portion is inclined in accordance with the inclining of an injector body, the larger-diameter portion and smaller-diameter portion roll on the convex surface formed on one of them, to only change a contact point slightly. Accordingly, the smaller-diameter portion does not follow up the inclining of the larger-diameter portion, and the operation of the intensifying piston is kept smooth.

The convex surface mentioned above is a part of a spherical surface. The center of a sphere forming this spherical surface is preferably set in, for example, the intensifying chamber. When the center of a sphere forming the convex surface is set in such a position, the intensifying force which the larger-diameter portion exerts on the smaller-diameter portion remains as being directed toward the center of the sphere, which forms the spherical surface, i.e., toward the intensifying chamber even when the larger-diameter portion is inclined and in spite of the degree of the inclination. Therefore, the influence of the inclining of the larger-diameter portion upon the effect of increasing fuel pressure by the intensifying piston is minimized.

The convex surface is formed on the top surface of the smaller-diameter portion or the bottom surface of the larger-diameter portion. Namely, the convex surface is formed on either one of the top surface of the smaller-diameter portion and the bottom surface of the larger-diameter portion. The surface which is not formed convexly is formed flat. The convex surface can be formed on both the top surface of the smaller-diameter portion and the bottom surface of the larger-diameter portion. When the convex surface is formed on both the top surface of the smaller-diameter portion and the bottom surface of the larger-diameter portion, the two convex surfaces are set in an opposed condition.

The convex surface is formed so that the apex thereof is positioned on the axis of the smaller-diameter portion or larger-diameter portion on which it is formed. When such a structure is employed, the force of the pressure in the pressure chamber transmitted to the smaller-diameter portion via the larger-diameter portion and the force by which the return spring presses the larger-diameter portion via the smaller-diameter portion are all transmitted via the apex of the convex surface in a normal condition in which the inclining of the injector body does not occur. Since the force exerted on the apex passes the axis of the smaller-diameter portion or larger-diameter portion, a galling does not occur on the slide surfaces thereof. Even when the larger-diameter portion is inclined in accordance with the inclining of the injector body to cause the point at which the convex surface contacts the top surface or bottom surface to be shifted from the axis on which the apex of the convex surface is positioned, the gouging and galling which are made in the slide surfaces by the smaller-diameter portion and larger-diameter portion are minimized.

In this fuel injection system for engines, wherein the fuel pressure supplied from the common rail to the intensifying chamber is increased by the intensifying piston and injected into the combustion chamber as described above, the intensifying piston is formed of a larger-diameter portion forming a part of the wall surface of the pressure chamber, and a smaller-diameter portion forming a part of the wall surface of the intensifying chamber and engaged with the larger-diameter portion by the resilient force of the return spring, and at least one of the top surface of the smaller-diameter portion and the bottom surface with which this top surface is engaged of the larger-diameter portion is formed convexly. Therefore, even when the injector body is inclined due to the clamping force occurring when the injector body is fixed by a clamp member and a tightening bolt, the thermal expansion of the cylinder head or a difference between the thermal expansion coefficient of the cylinder head and that of the manifold to cause the larger-diameter portion of the intensifying piston to nearly follow up the inclining of the injector body, the smaller-diameter portion and larger-diameter portion engage each other owing to the provision of the convex surface on the contact surfaces, i.e. the bottom surface of the larger-diameter portion and the top surface of the smaller-diameter portion, so that the smaller-diameter portion does not follow up the inclining of the larger-diameter portion, i.e., the bending moment is not exerted on the smaller-diameter portion. Accordingly, the smaller-diameter portion does not receive a bending force, and a resistance due to galling does not occur between the intensifying piston and the wall of the injector body, which defines a bore, of the fuel injection system. As a result, an imperfect operation of the intensifying piston does not occur, nor does such abnormal abrasion that increases the leakage amount of fuel in the intensifying chamber occur on the slide surfaces of the smaller-diameter portion and the opposed bore-defining wall. This enables desired levels of injection pressure and injection rate to be secured.

DETAILED DESCRIPTION OF THE EMBODIMENTS

Figure 1:
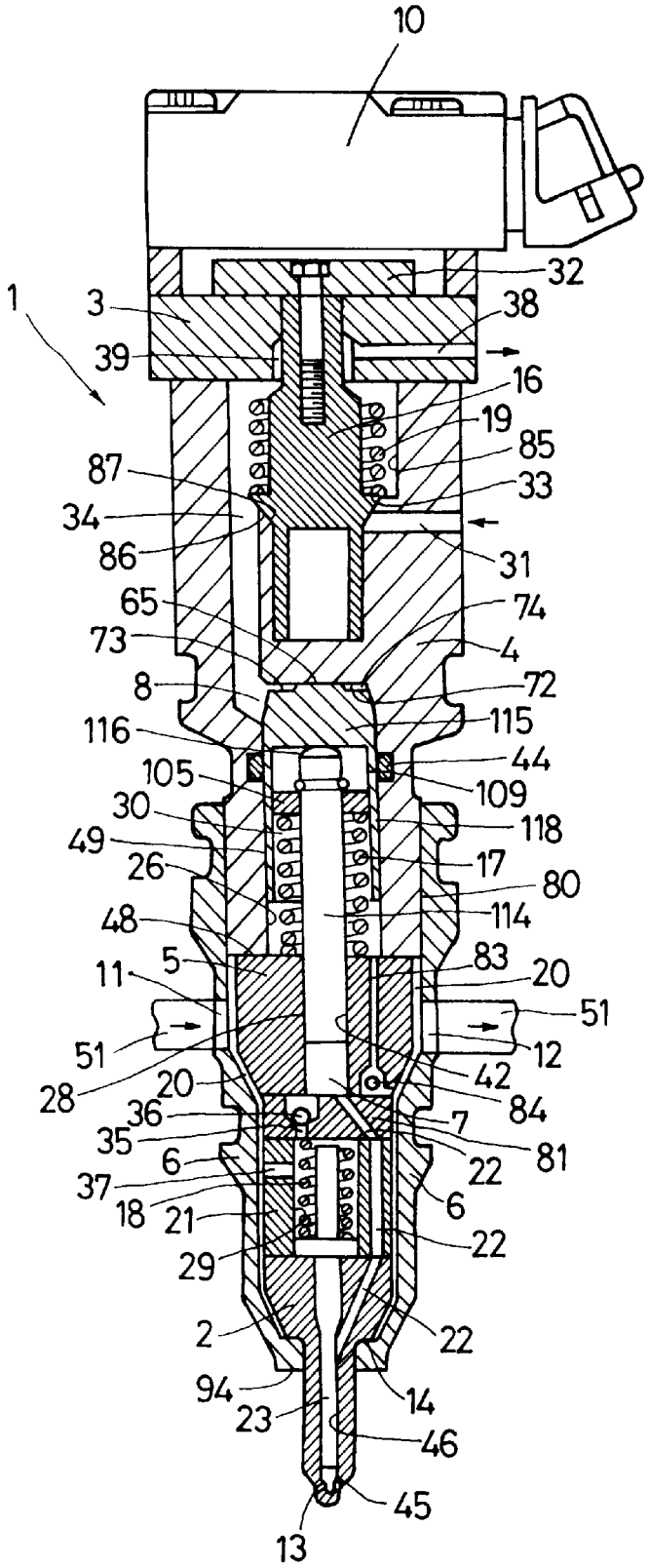
FIG. 1 is a sectional view showing an embodiment of the fuel injection system for engines according to the present invention.
Figure 5:
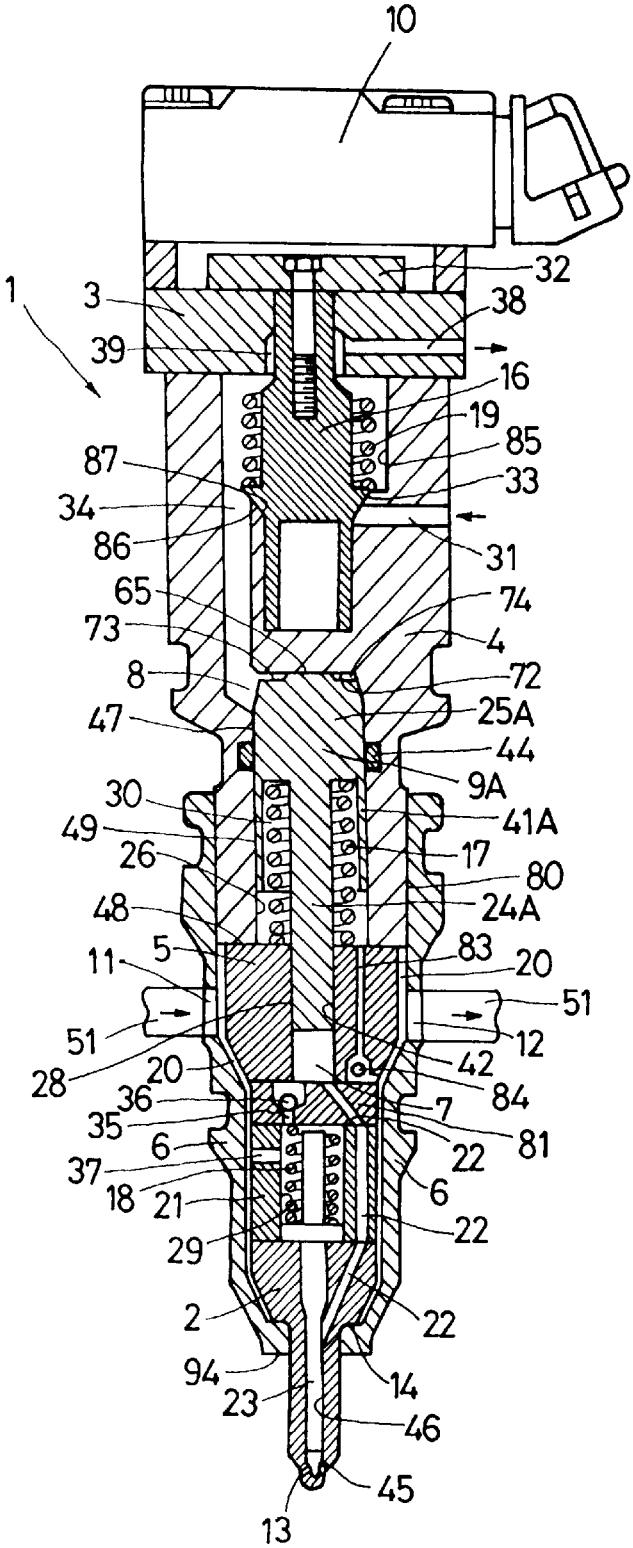
FIG. 5 (PRIOR ART)
FIG. 5 is a sectional view showing a conventional fuel injection system for engines.
Figure 6:
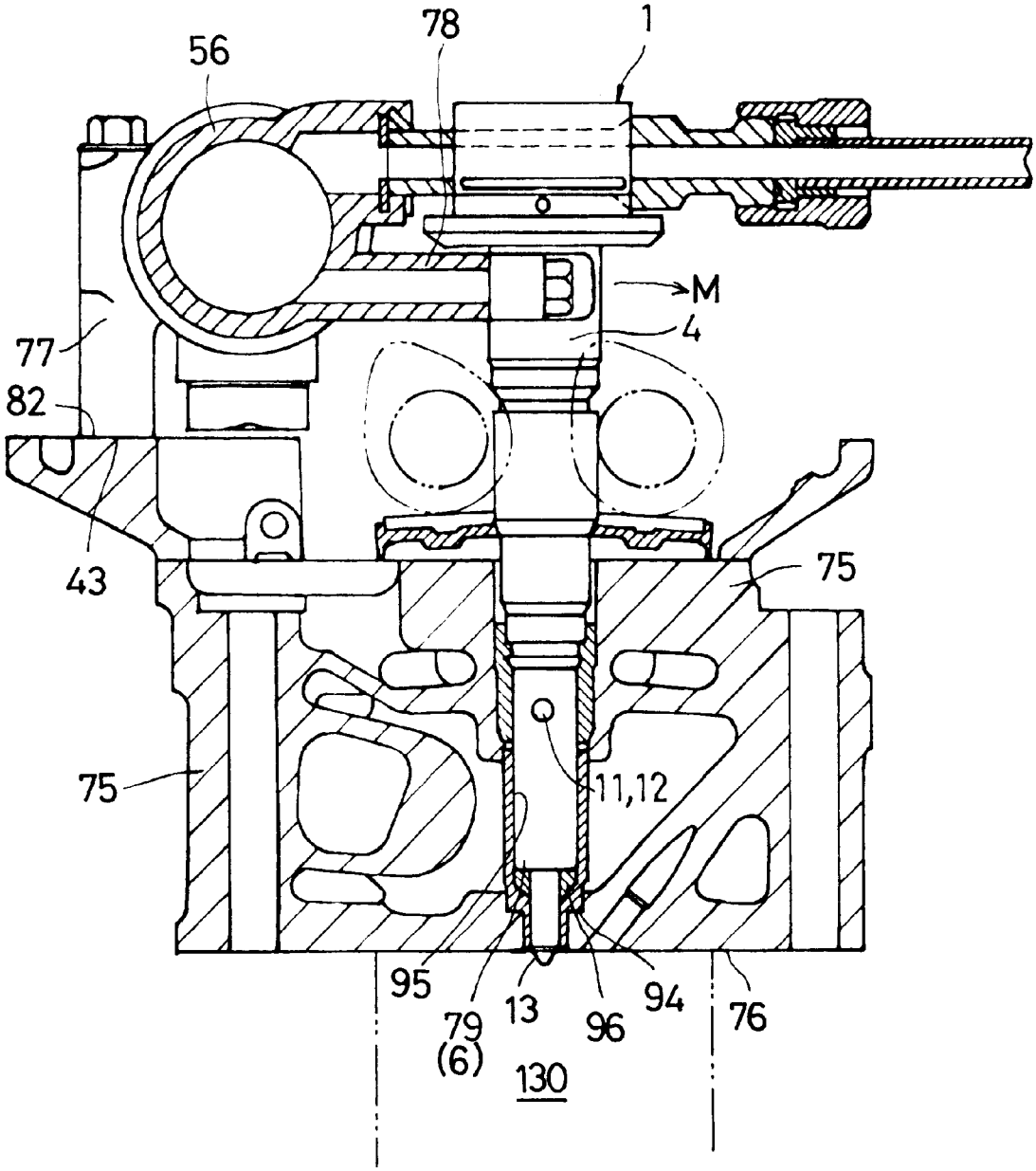
FIG. 6 is a drawing showing the fixing relation between a cylinder head and a manifold in an electronically controlled hydraulically driven fuel injection system.

The embodiments of the fuel injection system for engines according to the present invention will now be described with reference to the drawings. In the embodiment shown in FIG. 1, the parts having the same functions as those of the conventional example shown in FIG. 5 are designated by the same reference numerals, and the duplicated descriptions thereof are omitted.

Figure 2:
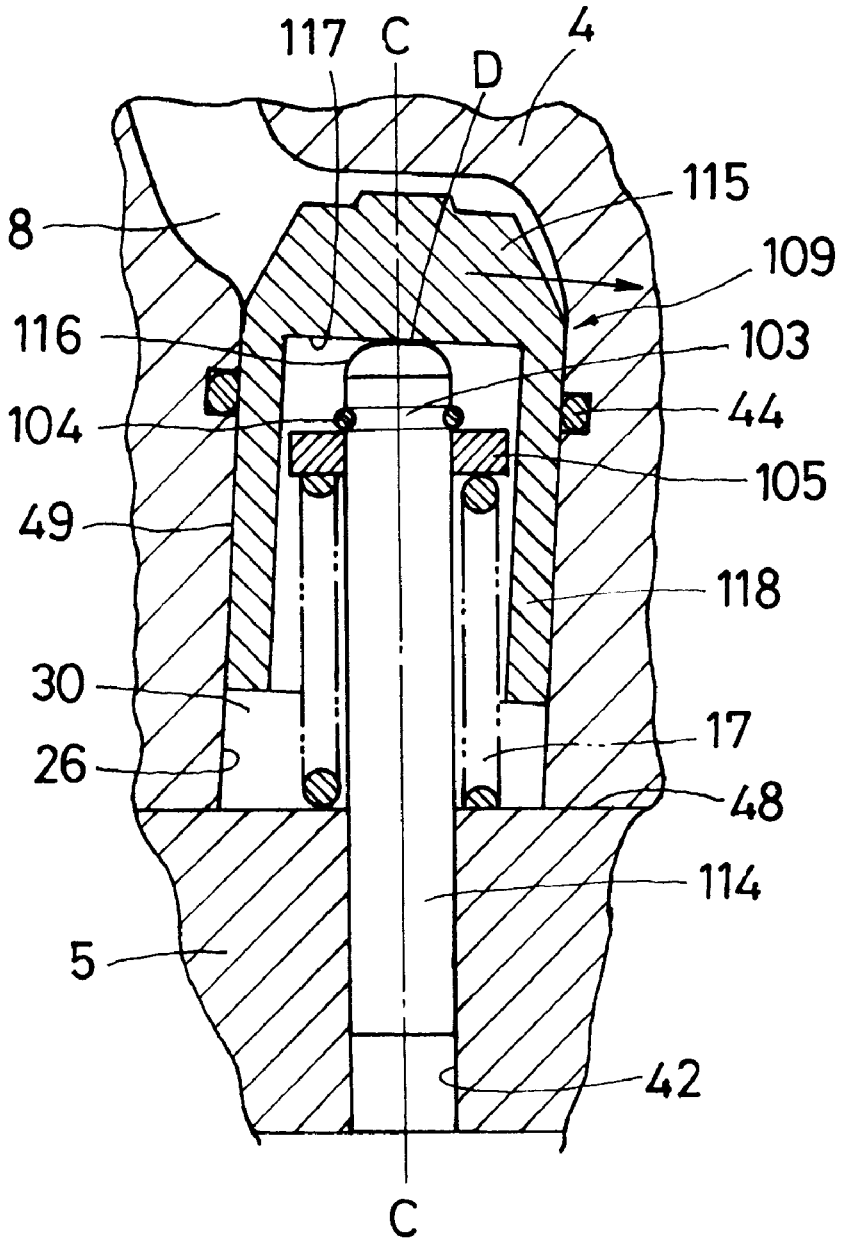
FIG. 2 is an enlarged sectional view of a principal portion of the same embodiment of the fuel injection system for engines according to the represent invention.
Figure 4:
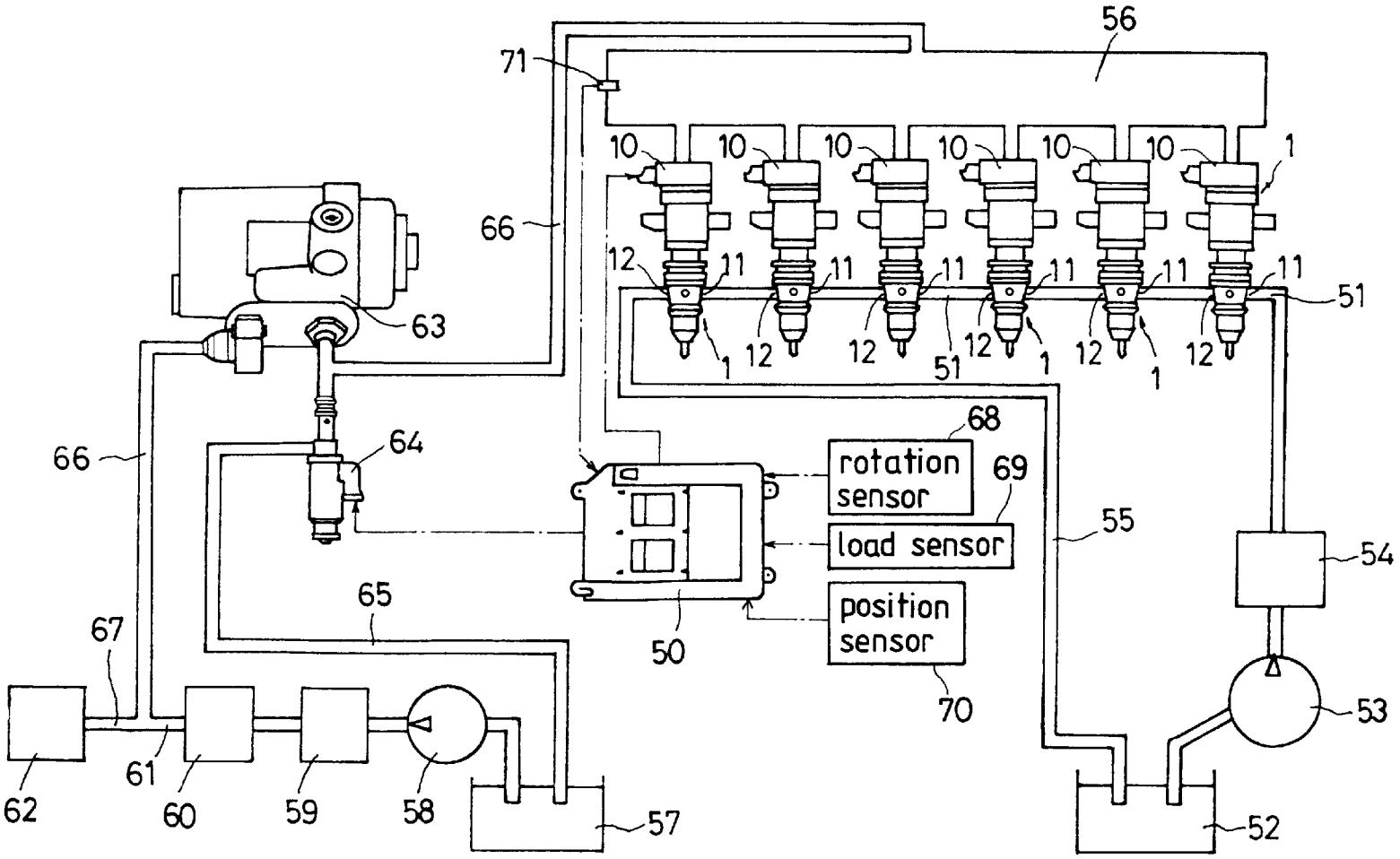
FIG. 4 is a schematic explanatory view showing a fuel supply system for a fuel injection system for engines.

This fuel injection system for engines is used by being incorporated in the fuel supply system shown in FIG. 4, and it is provided in each cylinder of an engine. In this embodiment, one fuel injection system will be described with reference to FIGS. 1 and 2. A fuel injection system 1 is opened at its fuel supply port 11 and fuel discharge port 12 into a common rail 51 in the fuel supply system, and it is always in the condition to receive a fuel from the common rail 51. An intensifying piston 109 in the fuel injection system 1 a principal portion of which is shown in FIG. 2 has separately formed smaller-diameter portion 114 and larger-diameter portion 115. The larger-diameter portion 115 has a guide ring 118 suspended from a circumferential section thereof. The circumferential surfaces of the smaller-diameter portion 114 and larger-diameter portion 115 are arranged concentrically so that the axes of the two portions are aligned with each other. A return spring 17 is provided in a compressed state between an upper surface of a fuel supply body 5 and a spring retainer 105. Accordingly, the smaller-diameter portion 114 is urged toward the larger-diameter portion 115 via the spring retainer 105 and a snap ring 104 to have the smaller-diameter portion 114 to follow up the action of the larger-diameter portion 115.

A bottom surface 117 of the larger-diameter portion 115 of the intensifying piston is formed flat, while a top surface 116 at which the smaller-diameter portion 114 contacts the larger-diameter portion 115 is formed convexly and generally smoothly. Therefore, a region in which the top surface 116 of the smaller-diameter portion 114 contacts the bottom surface 117 of the larger-diameter portion 115 is limited to a small dot-like or nearly dot-like region. A concrete shape of the convex surface is a shape of a part of a sphere. The convex surface is formed so that the apex thereof is positioned on the axis C—C of the smaller-diameter portion. Therefore, in a proper condition in which an injector body 4 is not inclined, the top surface 116 of the smaller-diameter portion 114 contacts the bottom surface 117 of the larger-diameter portion 115 at the apex of the convex surface, and the force exerted between the smaller-diameter portion 114 and larger-diameter portion 115 passes through the axis of the smaller-diameter portion 114 and is well-balanced. The radius of curvature (this radius of curvature is shown in an exaggerated manner) of the spherical surface is set so that the center of the sphere forming this spherical surface is positioned on a lower end surface of the smaller-diameter portion 114 constituting a wall surface of an intensifying chamber 7.

The fuel injection system 1 is formed as described above and operated as follows. The intensifying piston 109 shown in FIG. 2 is in the condition in which the injector body 4 is inclined due to the tightening of the fuel injection system by a clamp member and a tightening bolt, or the thermal expansion of a cylinder head 75 and a difference between the thermal expansion coefficient of the cylinder head 75 and that of a manifold 52. Referring to FIG. 2, the inclining of the injector body 4 is shown exaggeratedly for the explanation thereof but the practical inclination of the injector body 4 is very little and does not cause a clearance 48, which is very narrow and exists between the injector body 4 and fuel supply body 5, to expand.

Even when the larger-diameter portion 115 follows up the inclining of the injector body 4, the bottom surface 117 of the former rolls on the convex surface, the top surface 116 of the smaller-diameter portion 114 as the bottom surface 117 contacts the convex surface, whereby the two surfaces 116, 117 are displaced relatively to each other, the center of the contact being shifted as shown by a reference letter D in FIG. 2. However, the amount of this displacement is very small with respect to a contact position (on the axis C—C of the smaller-diameter portion 114) in which the larger-diameter portion 115 is in a non-inclined condition, and the contact point of the smaller-diameter portion 114 and larger-diameter portion 115 is not shifted immediately to an edge of a top section of the smaller-diameter portion 114 unlike the similar contact point in a conventional intensifying piston structure. Even when the larger-diameter portion 115 is inclined with respect to the smaller-diameter portion 114, the guide ring 118 of the former does not interfere with the latter since the hollow space of the spring chamber 30 is provided.

When the larger-diameter portion 115 is inclined in accordance with the inclining of the injector body 4, it rolls and tilts as the bottom surface 117 thereof contacts the convex top surface 116 of the smaller-diameter portion 114. Accordingly the smaller-diameter portion 114 is little influenced by the inclining of the larger-diameter portion 115, and the bending moment is little exerted on the smaller-diameter portion 114. As long as the bending moment is not exerted on the smaller-diameter portion 114, galling and sticking do not occur between the smaller-diameter portion 114 and a wall defining a bore 42 of the fuel supply body 5. In consequence, the smaller-diameter portion 114 is reciprocatingly moved without a large resistance in the bore 42, and the intensifying piston 109 is smoothly operated. Since abnormal abrasion does not occur on the slide surfaces between the smaller-diameter portion 114 and the wall defining the bore 42, an abnormal leakage of a fuel from the intensifying chamber 7 does not occur, and desired levels of injection pressure and injection rate can be obtained.

When the convex surface formed on the top surface 116 of the smaller-diameter portion 114 comprises a part of a spherical surface, the bottom surface 117 of the larger-diameter portion 115 merely changes its contact point, when the injector body 4 is inclined, as it rolls on the top surface 116 no matter which the direction of inclination of the injector body 4 is. Therefore, the occurrence of bending moment in the smaller-diameter portion 114 can be prevented. When the apex of the convex surface is positioned on the axis C—C of the smaller-diameter portion 115, the force exerted by the larger-diameter portion 115 in a proper posture on the smaller-diameter portion 114 is directed along the axis C—C of the smaller-diameter portion 114 via the apex of the convex surface, so that the reciprocating movement of the smaller-diameter portion 114, i.e. the fuel intensifying action in the intensifying chamber 7 is made smoothly. When the convex surface is formed by a part of a spherical surface with the center of a sphere which forms this spherical surface positioned on a lower end surface of the smaller-diameter portion 114 constituting the wall surface of the intensifying chamber 7 (the radius of curvature of the illustrated convex surface is shown exaggeratedly), the force exerted on the smaller-diameter portion 114 by the larger-diameter portion 115 necessarily is directed toward the intensifying chamber 7 even if the larger-diameter portion 115 is inclined to cause the center of its contacting region to be shifted from the axis C—C of the smaller-diameter portion 114. Therefore, the influence upon the pressure increasing effect of the intensifying piston 109 is reduced to a minimum level.

Figure 3:
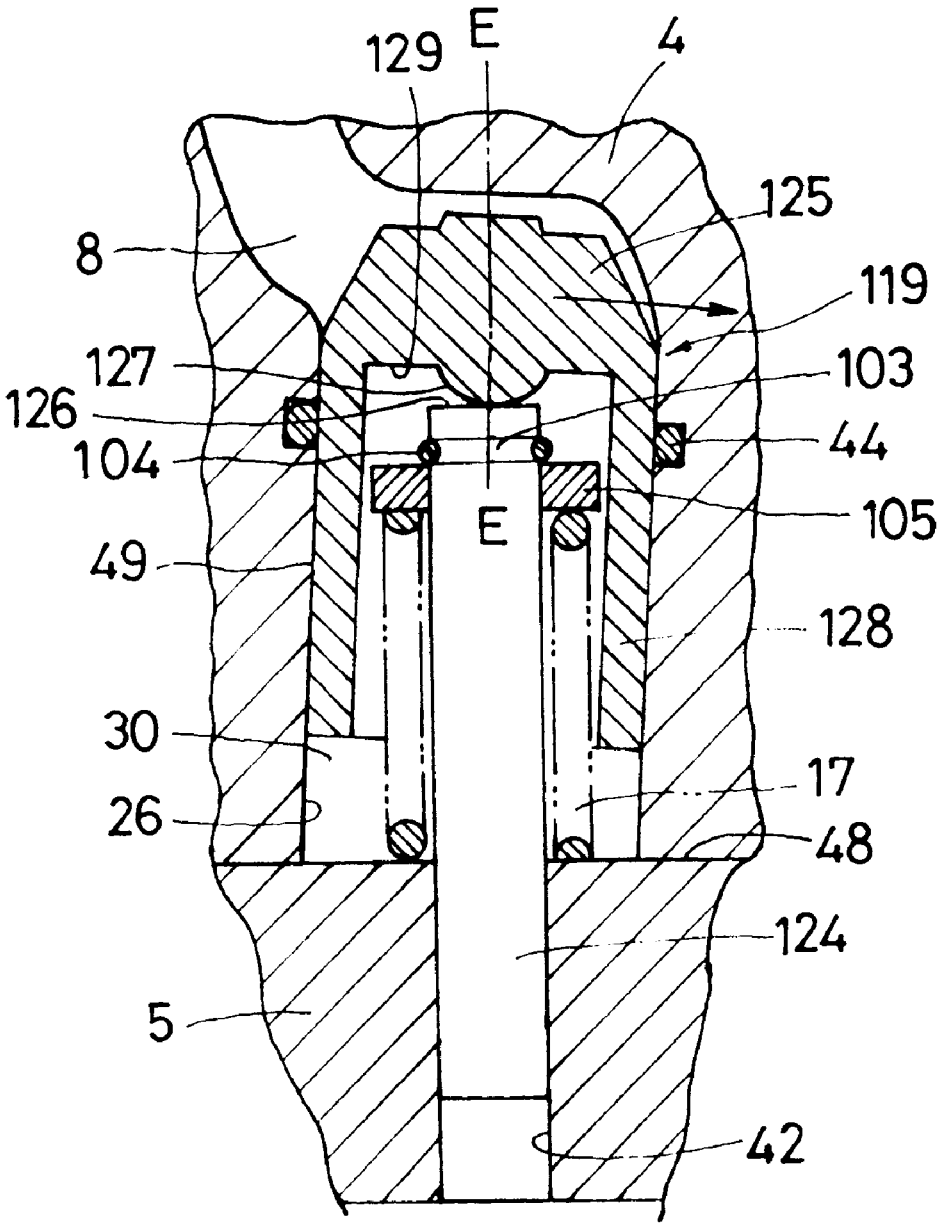
FIG. 3 is a sectional view showing another embodiment of the fuel injection system for engines according to the present invention.

FIG. 3 is a sectional view showing another embodiment of the fuel injection system for engines according to the present invention. In the embodiment of FIG. 3, the parts having the same functions as those of the embodiment of FIG. 2 are designated by the same reference numerals, and the duplication of the descriptions thereof is omitted.

Figure 7:
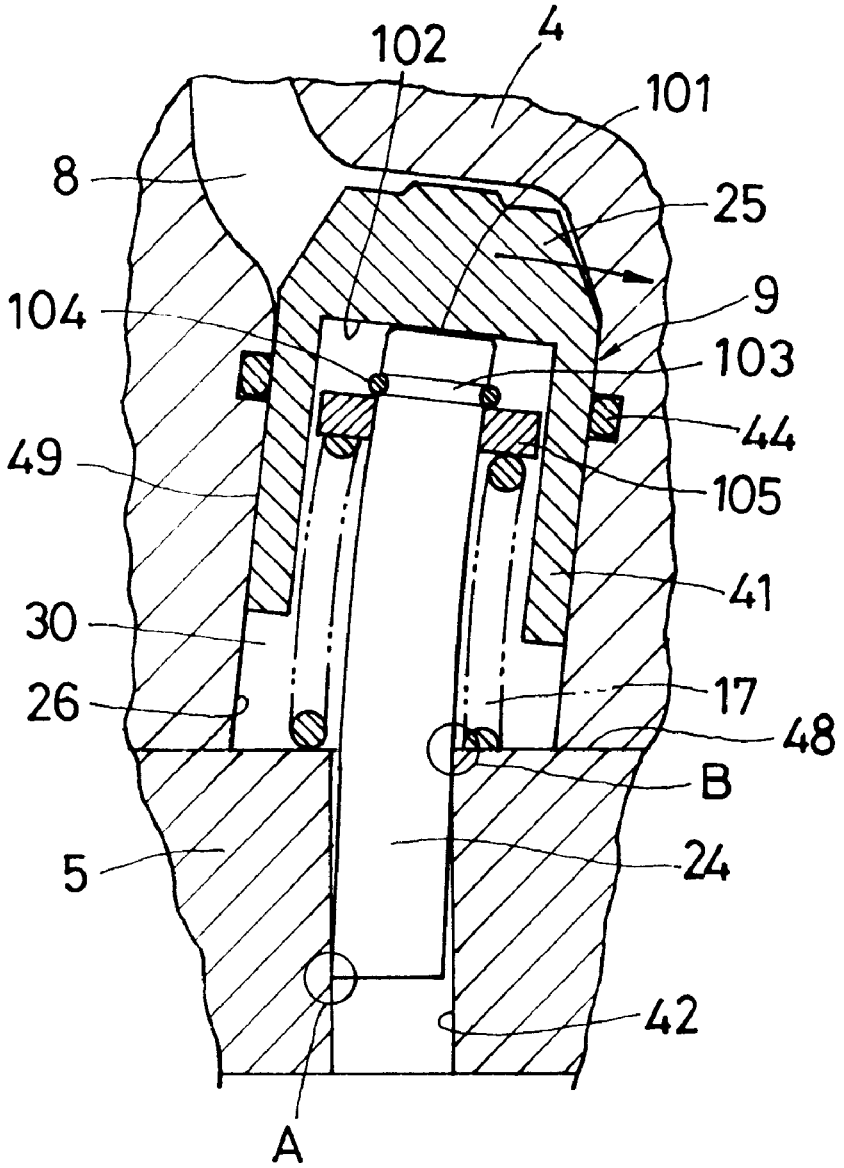
FIG. 7 (PRIOR ART)
FIG. 7 is a sectional view showing an inclined condition of an intensifying piston of a conventional fuel injection system for engines.

In the embodiment shown in FIG. 3, a convex surface 127 is formed on a bottom surface 129 of a larger-diameter portion 125. Namely, an intensifying piston 119 comprises a smaller-diameter portion 124, and the larger-diameter portion 125 provided with the convex surface, which extends toward the smaller-diameter portion 124, on the bottom surface 129 thereof. The larger-diameter portion 125 is provided with a guide ring 128 suspended from an outer circumferential section thereof. The smaller-diameter portion 124 is formed flat at its top surface 126 in the same manner as the smaller-diameter portion 24 shown in FIG. 7. The forming of the convex surface 127 of the larger-diameter portion 125 of a part of a spherical surface and the aligning of the apex of the convex surface 127 with the axis E—E of the larger-diameter portion 125 can be done in the same manner as in the embodiment of FIG. 2 in which a convex surface is formed as the top surface 116 of the smaller-diameter portion 114. When the apex of the convex surface 127 is aligned with the axis E—E of the larger-diameter portion 125 with the intensifying piston in a non-inclined proper posture, it is aligned with an axis (not shown) of the smaller-diameter portion 124. Consequently, the transmission of a force between the smaller-diameter portion 124 and larger-diameter portion 125 is carried out smoothly not only when the intensifying piston is in a proper posture but also when the intensifying piston is inclined due to the inclining of the injector body to cause the apex mentioned above to deviate, if any, from the axis E—E.

Each embodiment has been described above. The convex surface may be provided on both the top surface of the smaller-diameter portion and the bottom surface of the larger-diameter portion. Although a part of a spherical surface is referred to as a preferable surface constituting the convex surface, it is clear that other curved surface also meets the purpose as long as it is a smooth convex surface, and even when it is not a part of a spherical surface.

What is claimed is:

1. A fuel injection system for engines, comprising intensifying chambers, to which a fuel from a common rail is supplied, formed in injector bodies, intensifying pistons adapted to be driven by an operating fluid supplied to pressure chambers formed in said injector bodies so as to increase the pressure of said fuel in said intensifying chambers, needle valves adapted to be lifted in said injector bodies so as to open and close by a fuel pressure injection ports from which said fuel from said intensifying chamber is injected into combustion chambers, control valves for controlling the supplying of said operating fluid to said pressure chambers for the purpose of driving said intensifying piston properly, return springs for returning said intensifying pistons, and cases provided on the outer circumferential sides of said injector bodies so as to form fuel chambers, and having fuel supply ports and fuel discharge ports which are opened in said common rail, said intensifying pistons comprising larger-diameter portions forming parts of wall surfaces of said pressure chambers, and smaller-diameter portions forming parts of said wall surfaces of said intensifying chambers and engaged with said larger-diameter portions by the resilient force of said return springs, top surfaces of said smaller-diameter portions or bottom surfaces of said larger-diameter portions with which said top surfaces are engaged being formed as convex surfaces.

2. A fuel injection system for engines according to claim 1, wherein said convex surfaces comprise parts of spherical surfaces.

3. A fuel injection system for engines according to claim 1, wherein said convex surfaces are formed on said top surfaces of said smaller-diameter portions or said bottom surfaces of said larger-diameter portions.

4. A fuel injection system for engines according to claim 3, wherein said convex surfaces are formed so that the apexes thereof are positioned on the axes of said smaller-diameter portions or said larger-diameter portions on which said convex surfaces are formed.

5. A fuel injection system for engines according to claim 3, wherein said top surfaces of said smaller-diameter portions or said bottom surfaces of said larger-diameter portions with which said convex surfaces are engaged are formed flat.

6. A fuel injection system for engines according to claim 4, wherein said top surfaces of said smaller-diameter portions or said bottom surfaces of said larger-diameter with which said convex surfaces are engaged are formed flat.

7. A fuel injection system for engines according to claim 1, wherein said convex surfaces comprise parts of spherical surfaces and formed on said top surfaces of said smaller-diameter portions with the centers of spheres forming said spherical surfaces being positioned substantially on one end surfaces forming said parts of said wall surfaces of said intensifying chambers and with the apexes thereof being positioned on the axes of said smaller-diameter portions.

8. The fuel injection system for engines according to claim 1, wherein the top surfaces are spherical have respective center points set in the respective intensifying chambers.

* * * * *